United States Patent [19]

Frey

[11] 4,039,204

[45] Aug. 2, 1977

[54] SKI STOP WITH STRAP RELEASE

[76] Inventor: Max Frey, 3940 SW. Altadena Ave., Portland, Oreg. 97201

[21] Appl. No.: 663,862

[22] Filed: Mar. 4, 1976

[51] Int. Cl.[2] ..... A63C 7/10

[52] U.S. Cl. ..... 280/605; 280/637

[58] Field of Search ..... 280/604, 605, 637

[56] References Cited

U.S. PATENT DOCUMENTS

| | | | |
|---|---|---|---|
| 3,048,418 | 8/1962 | Gertsch | 280/605 |
| 3,785,663 | 1/1974 | Spieldiener et al. | 280/605 |
| 3,899,185 | 8/1975 | Martin | 280/605 |
| 3,918,730 | 11/1975 | Schultes | 280/637 |

FOREIGN PATENT DOCUMENTS

| | | | |
|---|---|---|---|
| 154,159 | 3/1958 | Austria | 280/605 |

*Primary Examiner*—Joseph F. Peters, Jr.
*Assistant Examiner*—David M. Mitchell
*Attorney, Agent, or Firm*—Lee R. Schermerhorn

[57] ABSTRACT

A pair of claws is held together in retracted position on top of the ski by a detachable spring clip on a safety strap connected to the ski boot. In an uncontrolled fall, the ski bindings release the ski which then exerts a strong pull on the safety strap, detaching the clip from the claws. The claws then swing apart laterally over the edges of the ski and into braking positions underneath the ski to prevent sliding of the release ski on the snow. Upon release of the ski bindings in a mild fall, or accidentally while riding up the ski slope on a chair lift, the released ski exerts a lesser pull on the safety strap which is insufficient to detach the spring clip, causing the ski to remain tethered to the skier's leg.

6 Claims, 4 Drawing Figures

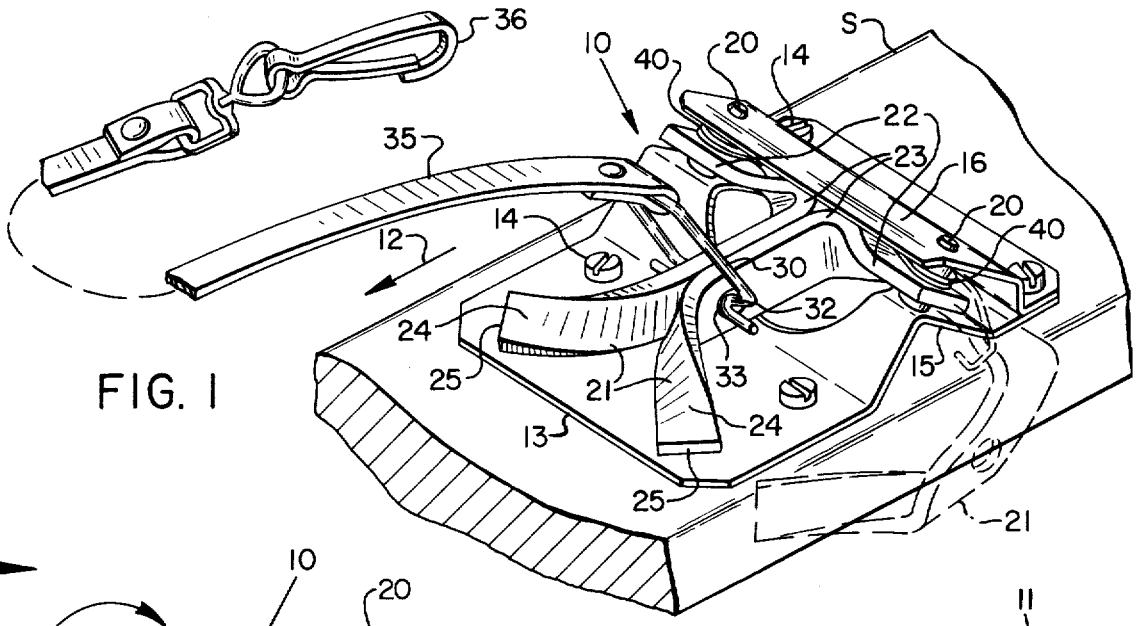
FIG. 1
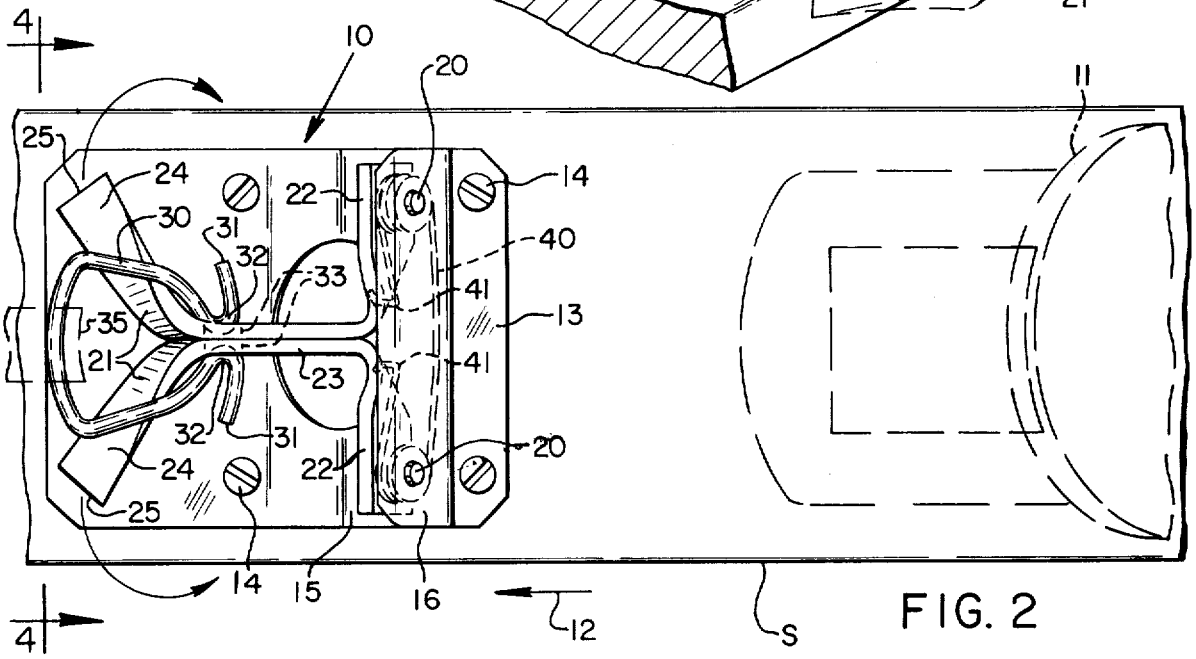
FIG. 2
FIG. 3
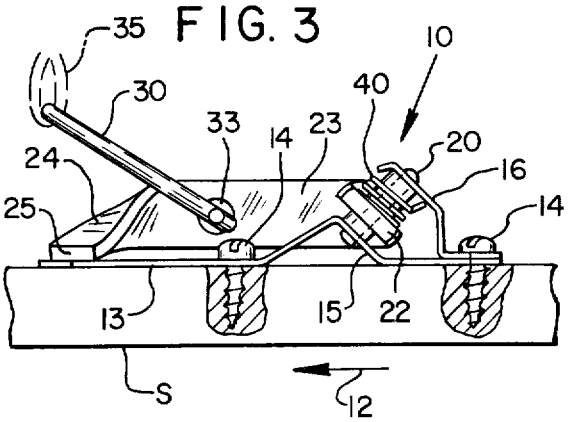
FIG. 4
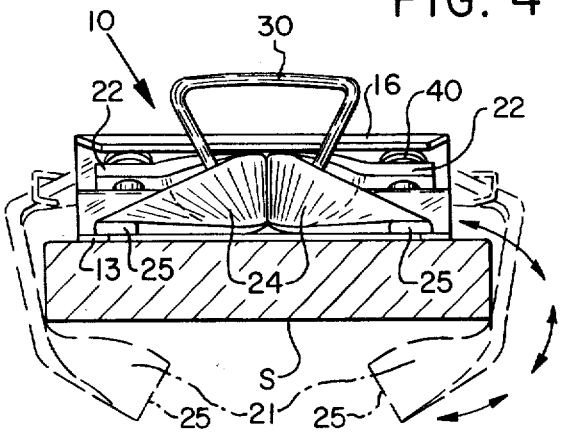

SKI STOP WITH STRAP RELEASE

BACKGROUND OF THE INVENTION

This invention relates to a braking device for stopping the free sliding of a ski on snow when the ski becomes separated from the ski boot in an uncontrolled fall.

Safety straps are often used to prevent a ski from sliding downhill after the ski has been released from the ski boot by the safety binding in a fall. Such a safety strap is attached to the ski and to the leg of the skier. However, during an uncontrolled fall, a skier may tumble many times and the ski, being connected to the skier's leg by the safety strap, can make wild gyrations referred to as windmilling. This has caused many injuries by the ski hitting the skier on the head or other parts of the body.

Ski stoppers were introduced to prevent this type of accident. However, such ski stoppers have not been widely accepted because situations are frequently encountered where a safety strap would be advantageous.

For example, if a binding should release accidentally while a skier is riding up the hill on a chair lift, the ski would drop off and the skier would have to ride to the top of the lift without the ski. Then he would have the difficult task of finding and retrieving the ski from the slope. Also, in a mild fall, it may be desirable to keep a released ski within easy reach. Other disadvantages of presently known ski stoppers are that they interfere during stepping in and stepping out of the binding, they may be effective in only one direction and they present protrusions on the sides of the skis which are objectionable when the skis are run on their edges.

Objects of the present invention are, therefore, to provide an improved ski stop which is not subject to the above-mentioned disadvantages, to provide a ski stop which retains certain advantageous features of a safety strap without endangering the skier, to provide a device of universal application to all known makes and styles of bindings and skis, and to provide a device of relatively simple and inexpensive construction which is superior to conventional safety straps and presently known ski stoppers.

SUMMARY OF THE INVENTION

In the present construction, a pair of pivotal claws is mounted on top of the ski, either in front of the toe binding or behind the heel binding. In the normally retracted position of the claws, no part of the device projects beyond the side edges of the ski. The claws are held in retracted position by a spring clip. The clip is connected to one end of a safety strap which is connected at its other end to the boot when the skier steps into the binding.

In the event of a bad fall, the conventional safety binding releases the ski from the boot and sufficient pull is exerted on the safety strap to detach the clip from the retracted claws, allowing the claws to swing down under the ski by spring action. The claws then form a brake to prevent the ski from free sliding down the slope away from the fallen skier. In a mild fall, the pull on the safety strap is not sufficient to detach the clip from the retracted claws and the ski remains connected to the boot after the boot has been released from the bindings.

If a binding should release accidentally while a skier is riding up the hill on a chair lift, the pull on the safety strap would be insufficient to detach the clip from the retracted claws and the ski would remain attached to the skier's leg. At the top of the lift, the attendant at the exit station could stop the chair and help the skier get off and reconnect the binding. It would not be necessary to search the slope for a lost ski.

The invention will be better understood and additional objects and advantages will become apparent from the following description of the preferred embodiment of the invention illustrated on the accompanying drawing. Various changes may be made in the details of construction and arrangement of parts and certain features may be used without others. All such modifications within the scope of the appended claims are included in the invention.

BRIEF DESCRIPTION OF THE DRAWING

FIG. 1 is a fragmentary perspective view of a ski equipped with a stop embodying the invention;

FIG. 2 is a top plan view;

FIG. 3 is a side elevation view; and

FIG. 4 is a view on the line 4—4 in FIG. 2.

DESCRIPTION OF THE PREFERRED EMBODIMENT

The present device, indicated in its entirety by the numeral 10, is mounted on the top surface of ski S either in front of the conventional safety release toe binding 11, or behind the heel binding, not shown. The foreward direction of travel of the ski is indicated by arrow 12.

A metal base plate 13 slightly narrower than the width of the ski is secured to the top face of the ski by screws 14. Plate 13 has flat front and rear portions to bear against the ski and an intermediate portion 15 which is inclined at an angle of approximately 45° to the top surface of the ski. An upper plate 16 overlies the inclined portion 15 in spaced parallel relation, as shown in FIG. 3. Pivot pins 20 inclined toward the rear end of the ski at angles of 45° are mounted at their ends in plate portions 15 and 16 to provide pivotal mountings for a pair of claws 21.

The claws 21 have laterally directed inclined rear ends 22 appertured to receive pivot pins 20, vertically disposed and longitudinally directed flat intermediate portions 23 which lie in face to face relationship in the retracted positions of the claws, and laterally divergent twisted end portions 24 with extremities 25 disposed in horizontal positions flat against base plate 13 in the retracted positions of the claws. Each claw is bent to this shape from a flat bar of metal.

Claws 21 are held in the retracted positions shown in solid lines in all the views by a generally U shaped spring clip 30. Clip 30 is preferably a piece of spring wire having oppositely bent ends 31 forming blunt, rounded nose portions 32 which engage in registering holes 33 in the juxtaposed flat vertical intermediate portions 23 of the claws. Clip 30 is connected to one end of a safety strap 35 having a fastener 36 on its opposite end for attachment to the ski boot. In the retracted positions of the claws, no part of the device projects beyond the side edges of the ski.

A pull of less than 15 pounds will not detach clip 30 from claws 21. When strap 35 exerts a pull in any direction of over 20 pounds on clip 30, the clip is pulled free of the claws. A single spring wire 40 has opposite end portions coiled around pivot pins 20 with the extremities 41 of the wire hooked under end portions 22 of the claws at a distance from the pivot pins. When clip 30 is detached from the claws, spring 40 swings the claws outward 180° in opposite directions to the broken line positions in FIGS. 1 and 4.

Thus, in braking position, intermediate portions 23 of the claws swing around opposite sides of the ski placing end portions 24 under the ski with the extremities 25 in a transverse vertical plane to exert maximum braking effect in either direction of movement of the ski. This position of the claws is determined by engagement of the claws with the side edges of the ski in the outward pivotal movements of the claws. It is preferred to mount the device with the retracted claws facing foward in relation to the direction of arrow 12, as shown.

In an uncontrolled fall, the ski is no longer connected to the skier's leg and the tumbling of the skier does not cause dangerous windmilling of the ski which has so seriously injured many skiers in the past. On the other hand, a mild fall which does not exert a pull of at least 15 pounds on strap 35 does not release the ski from the skier's leg, after the bindings have released the ski from the boot. This is a great convenience in retrieving the ski, and it has the additional safety features of enabling the skier to get back on his skis again quickly and out of the way of other skiers. The skier has the option, of course, of pulling strap 35 by hand to detach clip 30 at any time he may desire.

If the bindings should release the ski accidentally on a chair lift, the pull on strap 35 would normally be less than 15 pounds causing the ski to remain tethered to the skier's leg so that the ski would not have to be retrieved from the ski slope. This combination of advantages has not been attained by prior devices. As pointed out, these advantages are as important from the standpoint of safety as from the standpoint of convenience and enjoyment of the sport.

What is claimed is:

1. A ski stop comprising a base plate adapted for mounting on the top surface of a ski, a pair of pivot pins on said base plate inclined in longitudinal planes toward one end of the ski, a pair of claws pivotally mounted on the respective pivot pins, spring means arranged to swing angular free end portions of said claws around the opposite edges and underneath said ski, and release means normaly holding said claws in retracted positions on top of the ski spaced inwardly from said edges, said release means being detachable from said ski stop to release said claws for said swinging movements by said spring means, said release means comprising a strap having one end adapted for connection with a ski boot on said ski, and a release member on the other end of said strap engagable with said claws, said claws having intermediate portions in juxtaposition to each other in said retracted positions, and said release member comprising a spring clip clamping opposite sides of said juxtaposed portions.

2. A ski stop as defined in claim 1, said release member requiring a predetermined pulling force on said strap to release said claws.

3. A ski stop as defined in claim 2, said predetermined pulling force to release said claws being in the range of approximately 15 pounds to approximately 20 pounds.

4. A ski stop as defined in claim 1, said juxtaposed portions of said claws containing registering apertures, and said spring clip having a pair of opposed rounded noses engaging in said apertures.

5. A ski stop as defined in claim 1, said spring means comprising a spring wire having portions coiled around said pivot pins and end portions engaging said claws.

6. A ski stop comprising a base plate adapted for mounting on the top surface of a ski, a pair of pivot pins on said base plate inclined in logitudinal planes toward one end of the ski, a pair of claws pivotally mounted on the respective pivot pins, spring means arranged to swing angular free end portions of said claws around the opposite edges and underneath said ski, and release means normally holding said claws in retracted positions on top of the ski spaced inwardly from said edges, said base plate having an inclined portion normal to said pivot pins supporting lower ends of said pivot pins, and an inclined top plate normal to said pivot pins supporting upper ends of said pivot pins.

* * * * *